US005524395A

United States Patent [19]

Boiron

[11] Patent Number: 5,524,395

[45] Date of Patent: Jun. 11, 1996

[54] MOVABLE RAMP FOR PAINTING BOOTH

[75] Inventor: Michel Boiron, Champniers, France

[73] Assignee: Omia, Saint Yrieix, France

[21] Appl. No.: 318,178

[22] Filed: Oct. 5, 1994

[30] Foreign Application Priority Data

Oct. 8, 1993 [FR] France ..... 93 12033

[51] Int. Cl.[6] ..... E04B 1/346

[52] U.S. Cl. ..... 52/64; 187/217; 187/221

[58] Field of Search ..... 52/64, 19; 187/221, 187/217

[56] References Cited

U.S. PATENT DOCUMENTS 3,088,547 5/1963 MacMillan ..... 187/221 X
3,180,510 4/1965 Moller ..... 52/64
3,294,367 12/1966 Liskey ..... 187/221 X
3,996,704 12/1976 Huey ..... 52/64

*Primary Examiner*—Carl D. Friedman
*Assistant Examiner*—Beth A. Aubrey
*Attorney, Agent, or Firm*—Pollock, Vande Sande & Priddy

[57] ABSTRACT

A painting booth includes doors at one end through which a vehicle can enter. A dual section ramp always contained entirely within the booth has a fixed grid section located at an end of the booth, opposite the door, and a moveable section connected to the fixed section and located just inwardly of the door. A filter layer is attached to the fixed section for filtering air circulating downwards there through. A protective grate located in a lower wall section, below the moveable section, provides lateral protection against the introduction of foreign matter into the booth. Powered jacks, located underneath the moveable section of the ramp actuates the moveable section between inclined and horizontal positions. A retractable prop connected to an underside of the moveable section supports the weight of a vehicle when the moveable section is retained in the horizontal position.

7 Claims, 2 Drawing Sheets

MOVABLE RAMP FOR PAINTING BOOTH

FIELD OF THE INVENTION

The present invention relates to the field of motor-vehicle repair. The subject of the invention is in particular, a system of equipment intended for painting booths, or preparation areas, for the purpose of restoring vehicles or body components.

BACKGROUND OF THE INVENTION

Known enclosures, especially painting booths, generally encompass the entire vehicle and occupy (substantial floor area) Moreover, legislation in force concerning the working conditions in this type of enclosure impose very strict installation and protection conditions with respect to the potential users. Thus, when the users are exposed to gaseous emissions of solvents and of paint, the enclosure must be equipped with very powerful air renewal and circulating devices.

The devices for protecting the user with regard to his environment generally include, in addition to high flow-rate ventilators and extractors, substructures on which the painting booth rests. These substructures are rarely located at floor level and represent a lift from the floor of the booth of the order of 400 mm.

In order to introduce the vehicle into the booth, the user provides the enclosure with fixed ramps placed at the front of the substructure and outside the installation.

The enclosures thus equipped have many drawbacks: the ramps greatly increase the floor area taken up by the installation and are often difficult to use, they are frequently heavy and they require precise alignment of the vehicle with respect to each of the axes of the ramps.

The present invention aims to alleviate these drawbacks by proposing a movable ramp device which can be fitted into and be integrated within, a treatment enclosure provided with a substructure.

For this purpose, the painting booth produced in the form of a plurality of panels connected together and resting on a substructure is characterized in that it includes a floor provided with at least one fixed part and with at least one movable part mutually interacting in the region of an articulation, the movable part being set into movement by (maneuvering means and of control means).

Other features and advantages of the present invention will emerge from the description given hereinbelow, with reference to the appended drawings which illustrate an exemplary embodiment, free of any limiting character, thereof. In the figures:

DETAILED DESCRIPTION OF THE INVENTION

Figure 1:
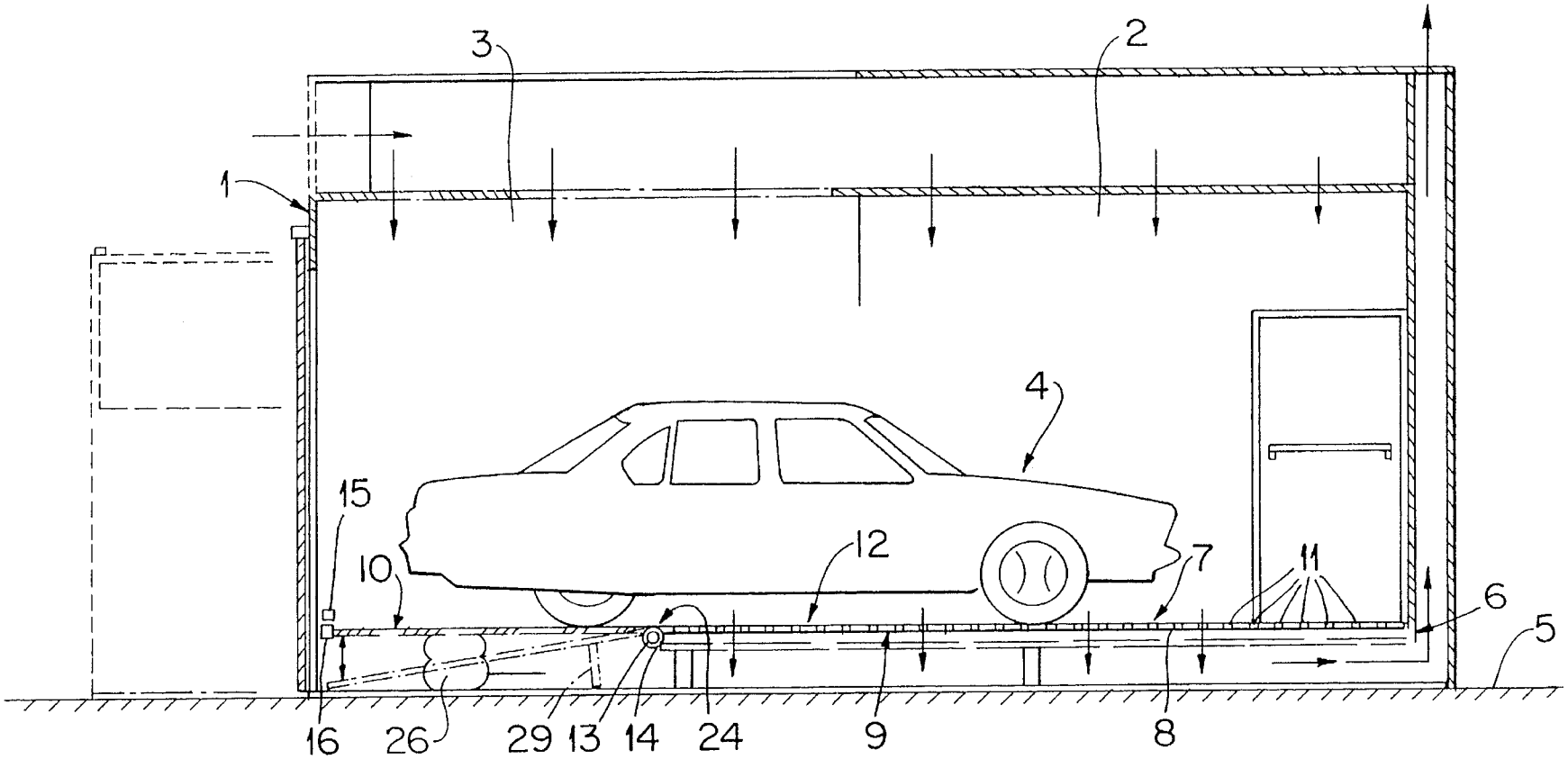
FIG. 1 is a sectional view, in side elevation, of an enclosure equipped with a movable ramp.
Figure 2:
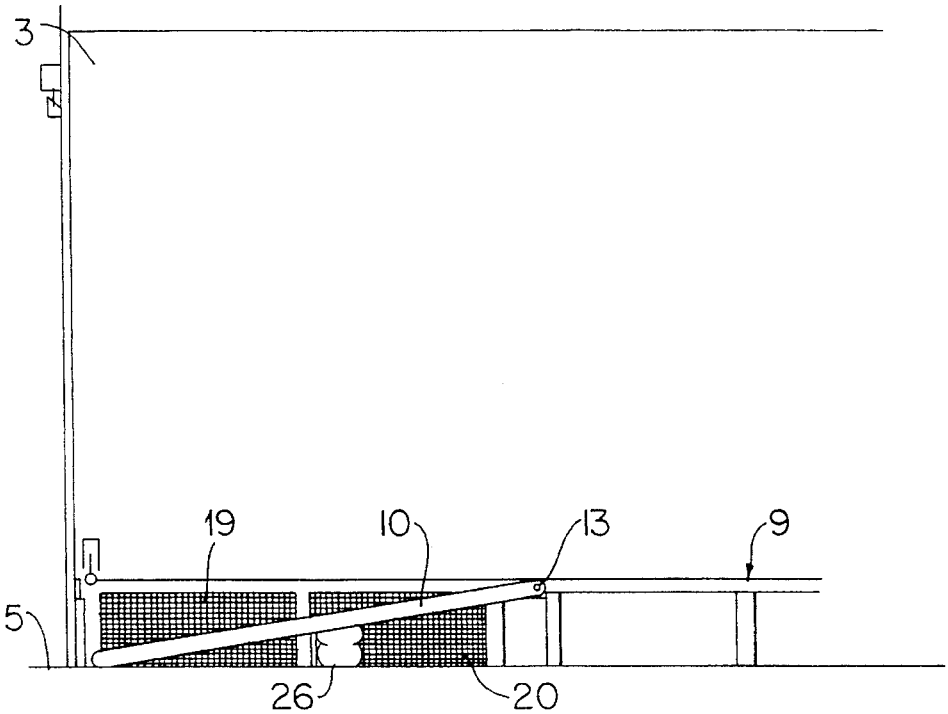
FIG. 2 is a partial sectional view, in side elevation, of the movable ramp.
Figure 3:
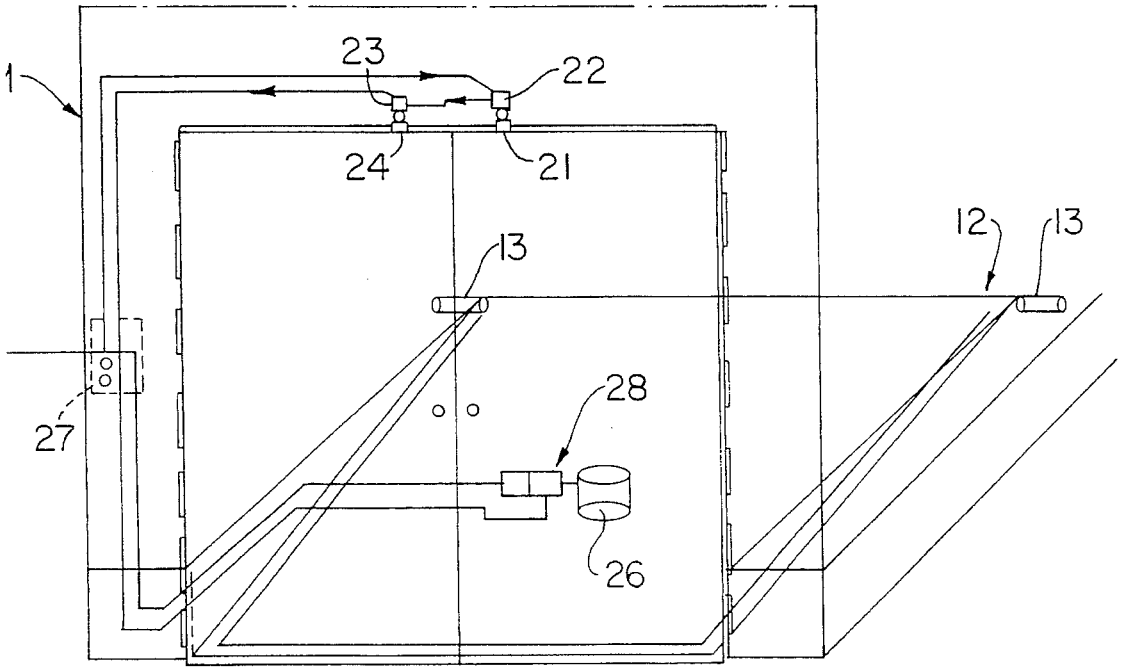
FIG. 3 is a perspective view of an enclosure according to the invention, equipped with the maneuvering devices.

According to a preferred embodiment of a repair enclosure 1 for a vehicle, it comprises a plurality of modular panels 2, 3, connected together so as to form a useful volume which completely encompasses the vehicle 4. This enclosure 1 is located on the floor 5 or on the substructure 6, formed with the aid of a metal frame 7 above a network of air extraction ducts and of particle filter baskets 8.

The floor 5 of this enclosure 1 is formed in two parts 9, 10, especially produced in the form of a grating, provided with openings 11 so as to allow free passage for the circulating gas flow, one 9 of them being fixed and the other 10 being movable and raisable. The joint 12 between these two parts 9, 10 is produced inside the booth 1 so that the movable part 10 does not extend further than the total length of the enclosure and therefore does not require any external floor area. The articulation 12 between the movable part 10 and the fixed part 9 is produced by means of at least one spindle 13 interacting with each of the ends of the respective parts, and it also comprises, in this region, a seal 14. Likewise, a flexible seal is located at the end 15 opposite the movable ramp 10, which guarantees sealing between the facing surfaces when the doors 17 and 18 of the enclosure are closed up.

Moreover, the width of the movable ramp 10 is designed to be similar to that of the access door of the enclosure, which further facilitates the introduction of the vehicle.

Furthermore, the lateral space 19 revealed in the region of the substructure 6 of the enclosure 1, especially when the ramp 10 is lowered, is covered with a protective grating 20 which prevents the introduction of foreign bodies beneath the substructure.

According to another feature of the invention, the enclosure 1 provided with the retractable ramp 10 includes a certain number of safety devices 21, 22; thus, the front of the enclosure, in the region of the zone of action of the opening doors, is provided with a plurality of end-of-travel means 23 which are actuated by stops 24 placed on the top of the frame of the doors. The lowering movement of the ramp is possible only when the doors are closed, whereas the raising movement is carried out with the doors open and is provided for by double- or single-acting, pneumatic or hydraulic jacks 26, generally located halfway along the ramp.

A control panel is provided on one of the front walls of the enclosure and comprises, in particular, valves 27 for acting on the distributor 28 controlling the jack 26, and indicators for monitoring the position state of the ramp. Depending on the technology employed, the information resulting from the end-of-travel means 23 makes it possible to actuate the setting-to-atmosphere of one of the chambers of the jack. Provision is especially made for installing power and control members inside the enclosure beneath the floor.

For safety reasons, the ramp is provided with retractable mechanical props 29 which maintain its position, even when the power members are no longer supplied, and in order to prevent any inopportune movement of the vehicle when the latter is placed in the enclosure, a chock 30 interacting through the openings 11 of the grating floor is located beneath any one of the wheels.

The method of using an enclosure equipped with a retractable ramp is as follows:

- the user closes the doors of the enclosure, which actuates the end-of-travel means and enables the lowering movement of the ramp; then
- he opens the doors and introduces the vehicle into the enclosure as far as the position marked by the chock;
- he closes the doors and actuates the upword movement of the ramp. This series of movement is reversed when the care is removed.

This operating method ensures that when the ramp is raised or lowered, and when the vehicle enters or exits, the user remains outside the booth out of harm's way. Moreover, provision is made for locating the entire vehicle on fixed and movable parts, which reduces the necessary overall length of the enclosure.

Of course, it remains the case that the present invention is not limited to the exemplary embodiments described and shown hereinabove, but that it encompasses all the variants thereof.

I claim:

1. A painting booth comprising:

a plurality of walls;

at least one end of the booth having an opening through which a vehicle can pass;

at least one door for closing the opening when a vehicle is enclosed in the booth;

a dual section ramp always contained entirely within the booth and including a) a fixed grid section located at an end of the booth opposite the door;

b) a moveable section connected to the fixed section and located just inwardly of the door, the moveable section being supported above a booth floor;

a first space existing between a lower surface of the ramp and the underlying booth floor;

a hinge connecting the fixed section to the moveable section;

a seal extending along the hinge to prevent circulation between a space portion under the moveable section and the space portion under the fixed section.

2. A booth as set forth in claim 1 further comprising means attached to the fixed section for filtering air circulating downwards there through.

3. A booth as set forth in claim 2 further comprising a second seal for sealing the space between an edge of the moveable section that confronts the door, and the door.

4. A booth as set forth in claim 2 further comprising a protective grate located in a lower wall section, in the vicinity of the first space, the grate providing lateral protection against the introduction of foreign matter into the first space.

5. A booth as set forth in claim 2 further comprising powered jacks, located in the first space and positioned underneath the moveable section of the ramp for actuating the moveable section between an inclined and a horizontal position.

6. A booth as set forth in claim 2 further comprising a retractable prop connected to an underside of the moveable section for supporting the weight of a vehicle when the moveable section is retained in the horizontal position.

7. A booth as set forth in claim 2 further comprising:

a second seal for sealing the space between an edge of the moveable section that confronts the door, and the door;

a protective grate located in a lower wall section, in the vicinity of the first space, the grate providing lateral protection against the introduction of foreign matter into the first space;

powered jacks, located in the first space and positioned underneath the moveable section of the ramp for actuating the moveable section between an inclined and a horizontal position; and a retractable prop connected to an underside of the moveable section for supporting the weight of a vehicle when the moveable section is retained in the horizontal position.

* * * * *